US008785803B2

(12) United States Patent
Garner

(10) Patent No.: US 8,785,803 B2
(45) Date of Patent: Jul. 22, 2014

(54) HIGH VOLTAGE SWITCH

(75) Inventor: Paul Anthony James Garner, Chemlsford (GB)

(73) Assignee: BAE SYSTEMS plc (GB)

( * ) Notice: Subject to any disclaimer, the term of this patent is extended or adjusted under 35 U.S.C. 154(b) by 703 days.

(21) Appl. No.: 12/305,297

(22) PCT Filed: Dec. 4, 2008

(86) PCT No.: PCT/GB2008/051155

§ 371 (c)(1),
(2), (4) Date: Aug. 11, 2009

(87) PCT Pub. No.: WO2009/081182

PCT Pub. Date: Jul. 2, 2009

(65) Prior Publication Data

US 2010/0230268 A1 Sep. 16, 2010

(30) Foreign Application Priority Data

Dec. 21, 2007 (EP) ..... 07255037
Dec. 21, 2007 (GB) ..... 0725248.9

(51) Int. Cl.
*H01H 33/91* (2006.01)
*H01T 4/12* (2006.01)

(52) U.S. Cl.
USPC ..... 218/146; 218/13

(58) Field of Classification Search
CPC ..... H01H 33/04; H01H 33/18; H01H 33/91; H01T 4/12; H01T 4/24
USPC ..... 218/48–50, 65, 74, 146, 123–131; 200/262–270
See application file for complete search history.

(56) References Cited

U.S. PATENT DOCUMENTS

| | | | | |
|---|---|---|---|---|
| 3,887,778 | A | 6/1975 | Farrall | |
| 4,628,399 | A | 12/1986 | Shigemori et al. | |
| 4,769,736 | A * | 9/1988 | Boy | 361/120 |
| 4,912,369 | A * | 3/1990 | Moran et al. | 315/58 |
| 6,617,770 | B2 * | 9/2003 | Machida | 313/231.01 |
| 2002/0171362 | A1 | 11/2002 | Machida | |
| 2006/0181219 | A1 * | 8/2006 | Emori et al. | 313/635 |

FOREIGN PATENT DOCUMENTS

DE 43 29 518 A1 8/1993

(Continued)

OTHER PUBLICATIONS

International Search Report and Written Opinion issued on Mar. 4, 2009 in International Application No. PCT/GB2008/051155.
Goerz et al. "A Low-Profile High-Voltage Compact Gas Switch". Lawrence Livermore National Laboratory. Jun. 29, 2007.
Cravey et al. "Picosecond High Pressure Gas Switch Experiment". Lawrence Livermore National Laboratory. Jun. 21, 1993.

(Continued)

*Primary Examiner* — Amy Cohen Johnson
*Assistant Examiner* — Marina Fishman
(74) *Attorney, Agent, or Firm* — Finch & Maloney PLLC

(57) ABSTRACT

A high voltage switch is provided, comprising a pair of electrodes housed within a high pressure gas vessel and separated by a nominal distance D. At least one of the electrodes is provided with raised surface features each having a radius of curvature that is significantly smaller than the electrode separation D. Preferably one of the electrodes is flat-faced. Preferred gas pressures within the pressure vessel are in the range 300 psi to 1200 psi. When used to switch voltages of several hundred kilovolts, an operational life for the electrodes of between 400 and 1000 hours has been achieved.

13 Claims, 9 Drawing Sheets

(56) References Cited

FOREIGN PATENT DOCUMENTS

| | | | |
|---|---|---|---|
| EP | 0251010 | A1 | 1/1988 |
| EP | 1 237 243 | B1 | 11/2006 |
| FR | 440 106 | A | 7/2012 |
| GB | 1 128 628 | | 2/1966 |
| JP | 03-062487 | A | 3/1991 |
| JP | 10-204322 | | 8/1998 |
| JP | 2007-265834 | | 10/2007 |

OTHER PUBLICATIONS

British Search Report issued in GB0725248.9, Apr. 10, 2008, 8 pages.
European Search Report issued in EP 07255037.9, Jun. 9, 2008, 8 pages.

* cited by examiner

+ve Electrode

–ve Electrode

HIGH VOLTAGE SWITCH

CROSS REFERENCE TO RELATED APPLICATIONS

This is the U.S. National Phase of PCT/GB2008/051155, filed Dec. 4, 2008, which claims priority to British Application No. 0725248.9, filed Dec. 21, 2007, and European Application No. 07255037.9, filed Dec. 21, 2007, the entire content of all of which are incorporated herein by reference.

This invention relates to a high voltage switch, in particular to a high pressure gas switch for use in high voltage, high power switching applications.

High pressure gas switches are widely used in high pulse power switching. They offer a very simple compact means of very high pulse power switching with low mass and volume. However, known designs for such switches have a relatively limited life due to uneven and damaging electrode wear.

Preferred embodiments of the present invention are as defined in the claims.

A switch according to preferred embodiments of the present invention has been found to have a long operational life, despite the high voltages being switched, of the order of several hundred kilovolts and instantaneous power levels of the order of Gigawatts. Long operational life is characterised in this invention by even wearing of the facing surfaces of the electrodes, so preserving the operational characteristics of the switch, with no significant localised damage such as pitting or fracturing. Operational life of the order of 400 to 1000 hours or more may be expected of switches according to preferred embodiments of the present invention when operating at these voltages and instantaneous power levels. Furthermore, the switch has been found to be less sensitive to temperature variations that may otherwise cause prior art switches to operate at reduced power levels outside optimal temperature ranges.

Preferred embodiments of the present invention will now be described in more detail, by way of example only, and with reference to the accompanying drawings of which:

Figure 1:
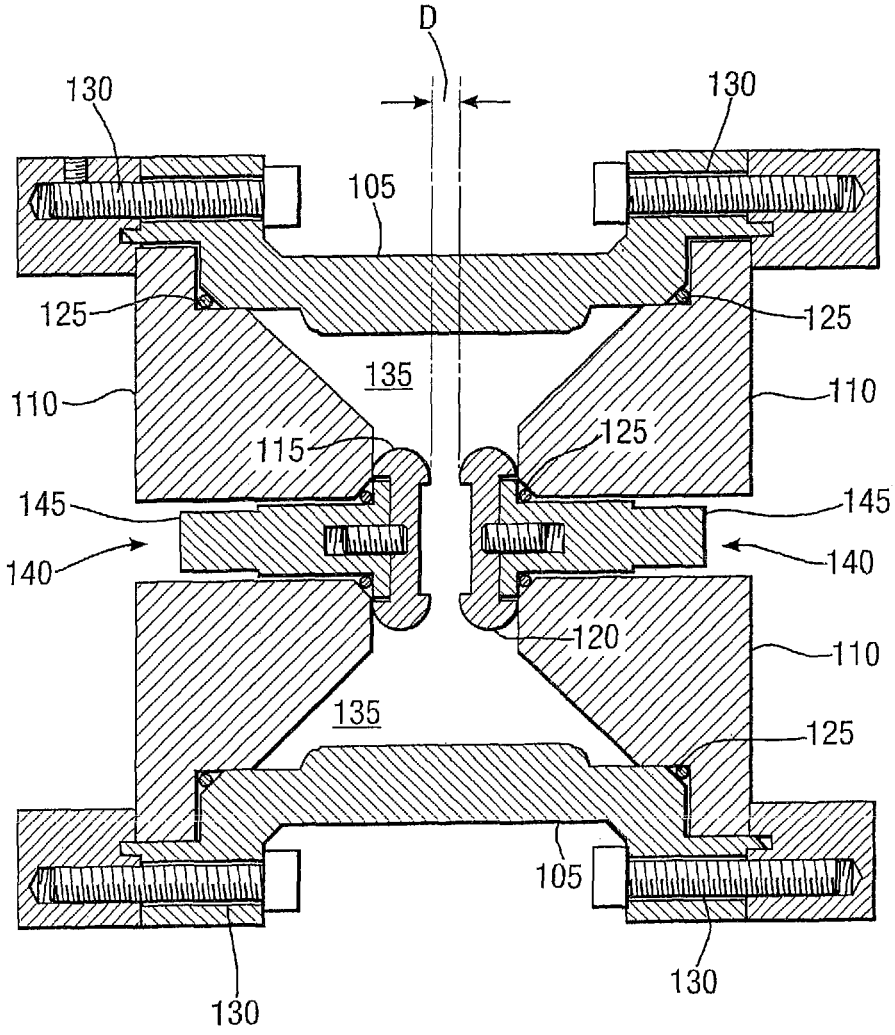
FIG. 1 is a sectional view through a high pressure gas switch according to a first preferred embodiment of the present invention.
Figure 3A:
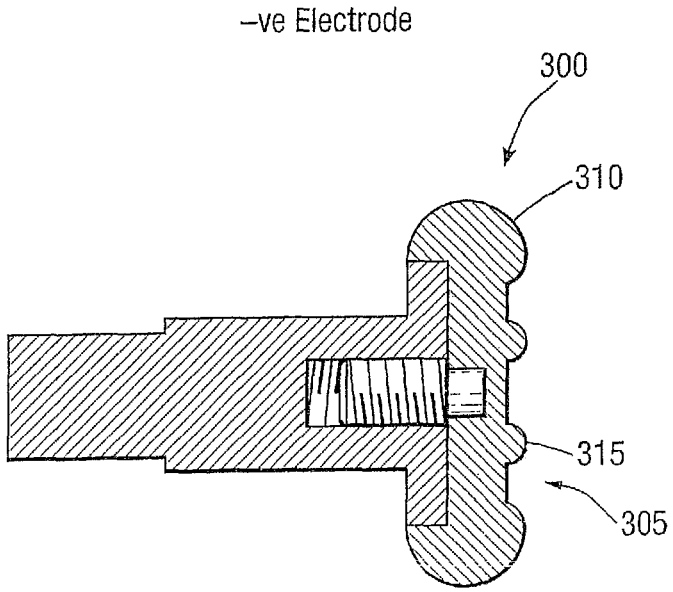
Figure 3B:
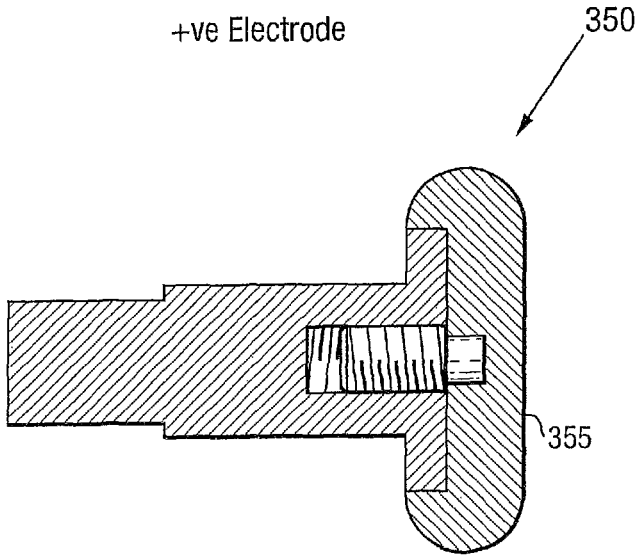
Figure 4:
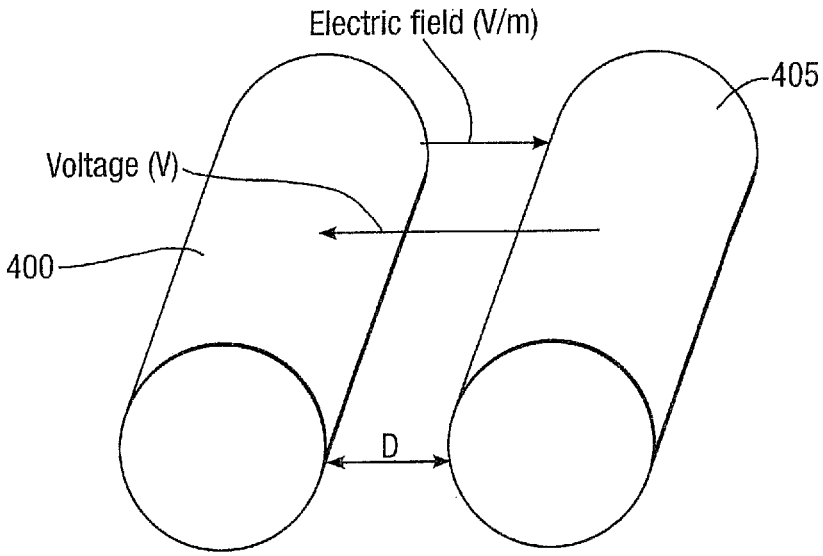
Figure 5:
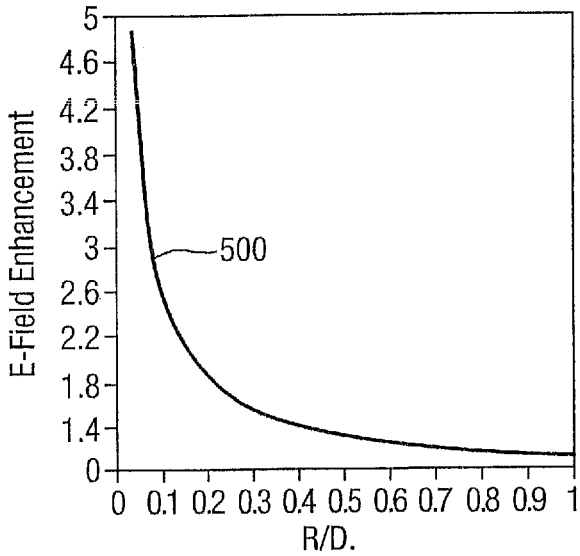
Figure 6:
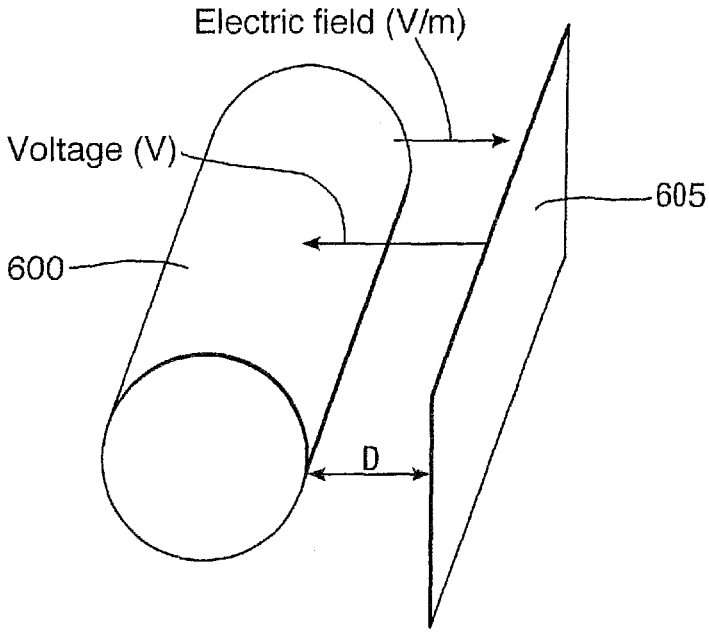

FIGS. 3*a* and 3*b* provide sectional views through an electrode pair according to a preferred design for use in the gas switch of FIG. 1 according to a third preferred embodiment of the present invention;

FIG. 4 is a simplified representation of the electrode configuration of the switch in FIG. 1;

FIG. 5 is a plot of the electric field enhancement arising in the simplified electrode arrangement in FIG. 4;

FIG. 6 is a simplified representation of the electrode configuration of the switch using the electrode pair shown in FIGS. 3 and 3*b;*

Figure 7:
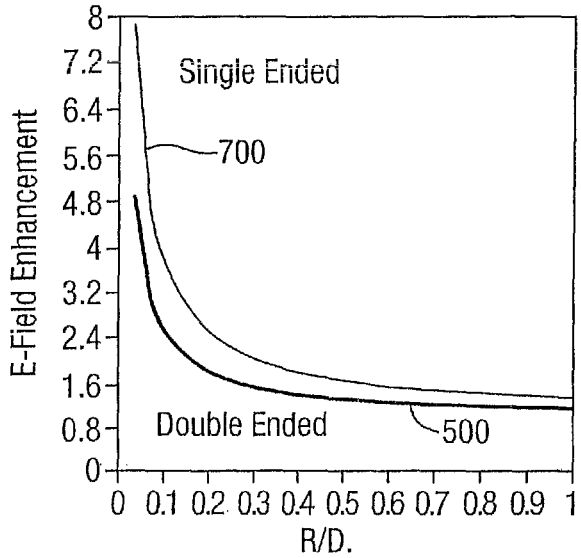
Figure 8A:
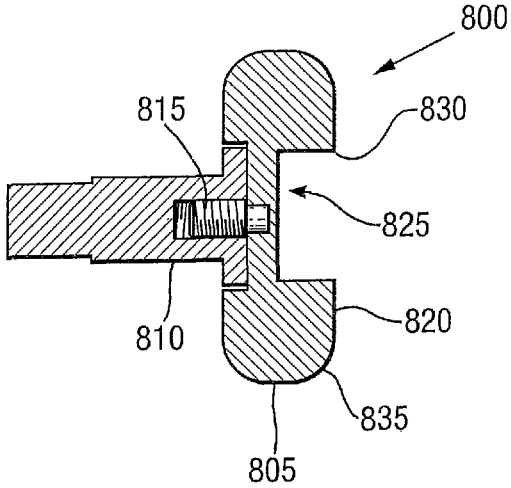
Figure 8B:
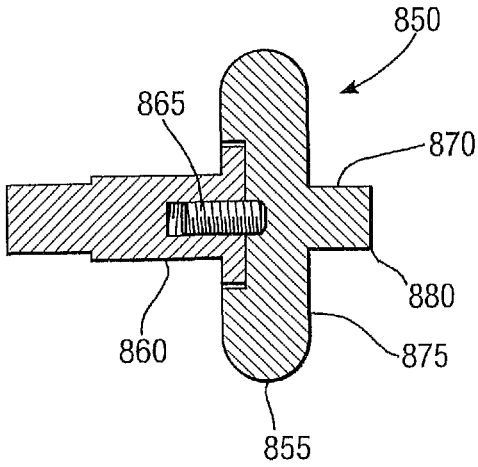
Figure 9:
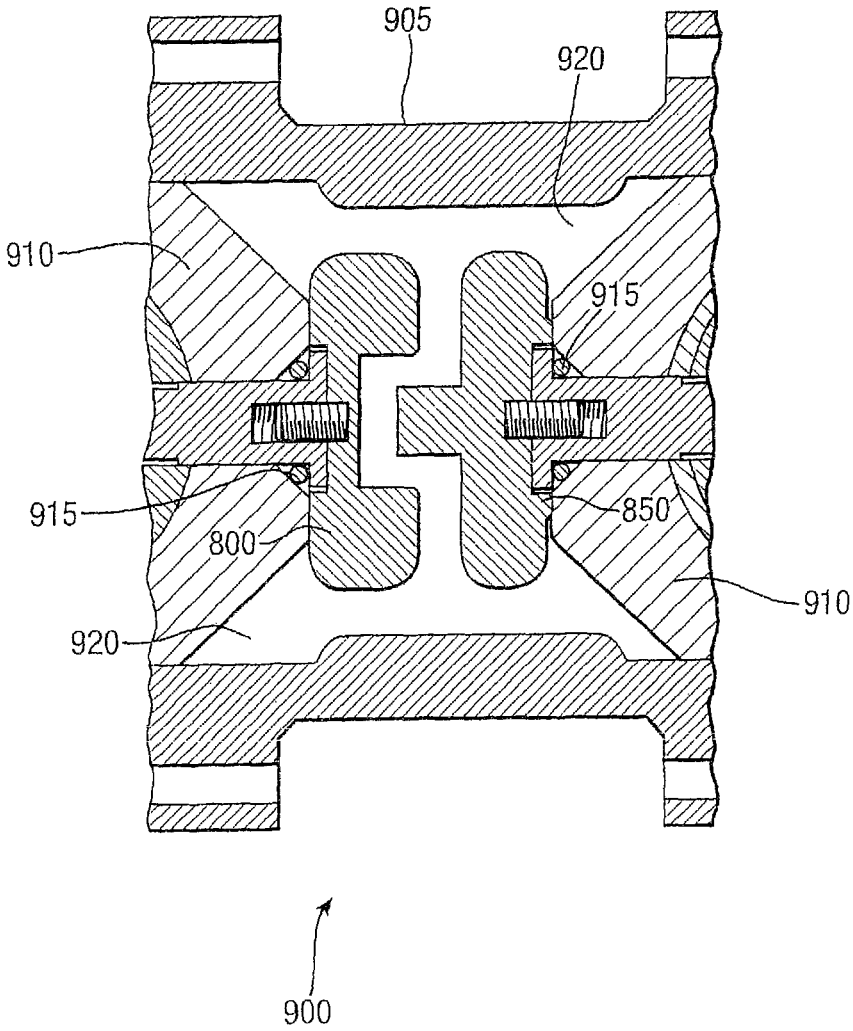
Figure 10:
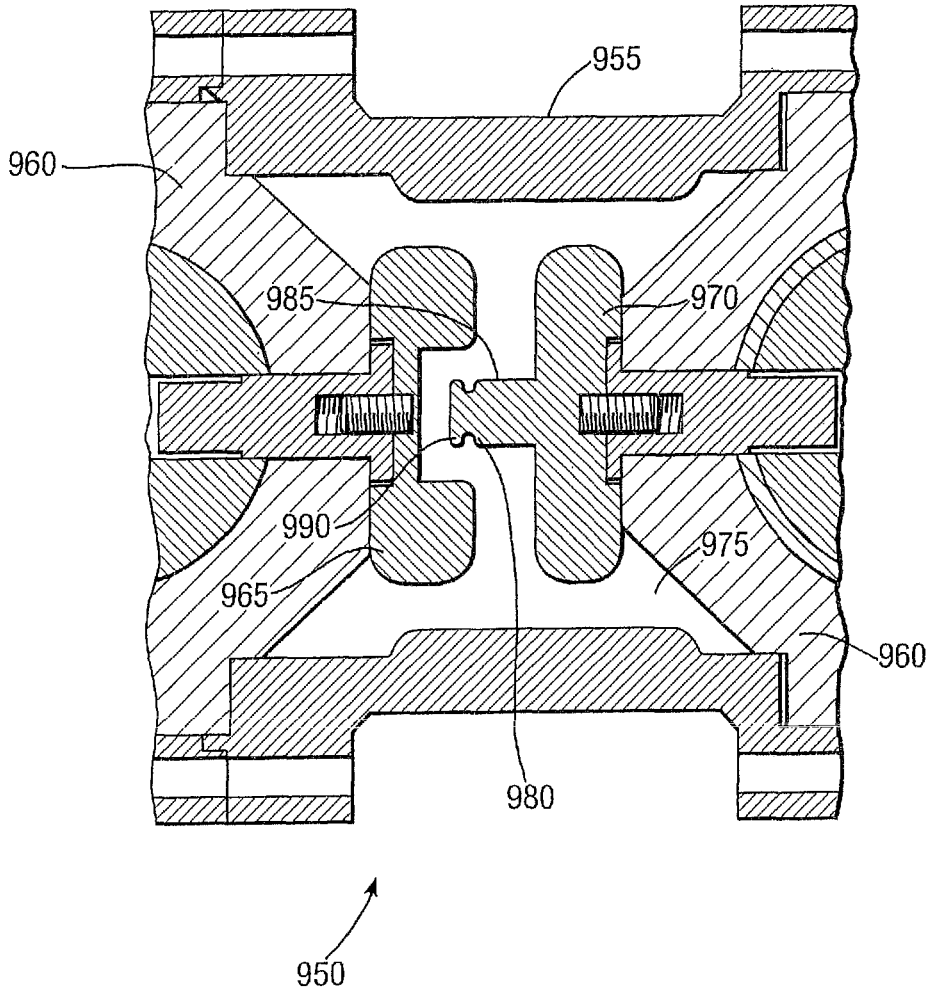

FIG. 7 is a plot of the electric field enhancement arising in the simplified electrode arrangement in FIG. 6, with the plot of FIG. 5 shown for comparison;

FIGS. 8*a* and 8*b* provide sectional views through an electrode pair according to a preferred design for use in the gas switch of FIG. 1 according to a fourth preferred embodiment of the present invention;

FIG. 9 provides a sectional view through a preferred high pressure gas switch incorporating the electrodes of FIGS. 8*a* and 8*b*, in a preferred embodiment of the present invention; and FIG. 10 provides a sectional view through a further preferred high pressure gas switch incorporating a preferred variation on the design of the electrodes of FIGS. 8*a* and 8*b*.

A simple high pressure gas switch according to a first preferred embodiment of the present invention will now be described with reference to FIG. 1. The switch may be used in a number of different applications, preferably those requiring the switching of voltages of the order of several hundred kilovolts at high instantaneous power levels, but at relatively low overall energy levels. Such applications are in contrast to switching in X-ray apparatus, for example, in which voltages of the order of megavolts or higher need to be switched, with high overall energy levels.

Referring to FIG. 1, a sectional view through the preferred high pressure gas switch 100 is shown. The switch 100 comprises a high pressure containment vessel 105, preferably made from a high strength metal such as stainless steel and in the shape of a cylinder. Insulating members 110, preferably made from ceramic or a plastic such as nylon or polypropylene, serve both as the end walls of the high pressure containment vessel and to electrically isolate a respective electrode 115, 120 from the cylindrical portion 105 of the vessel. Sealing rings 125 are provided to seal the vessel when in its assembled state with the insulating members 110 held securely in place by a number of bolts 130. The containment vessel provides a void 135 around the electrodes for holding a suitable gas, preferably nitrogen, hydrogen or $SF_6$, under very high pressure, preferably in the range of 300 psi to 1200 psi.

The electrodes 115, 120 are held in a fixed position by the insulating members 110 so that there is a nominal gap D between the electrodes 115, 120. Electrical connection to each of the electrodes 115, 120 is by means of an access hole 140 created in the respective insulating member 110 to expose a connecting portion 145 of the respective electrode 115, 120. Electrical connection to the electrodes 115, 120 is by any of a number of possible configurations, for example by means of a push-fit sleeve that may fit tightly around a slightly narrowed portion of the connecting portion 145 to ensure a reliable electrical connection. However, preferably, any such electrical connections may be additionally soldered or otherwise bonded for extra reliability appropriate to the voltage levels intended for this switch 100.

Preferred designs and advantageous features of the electrodes 115, 120 will now be described in more detail with reference, in particular, to FIG. 2 and to FIGS. 3*a* and 3*b*, according to second and third preferred embodiments of the present invention respectively. The electrodes in each of these preferred embodiments are intended for use as alternative designs for the electrodes 115, 120 in the high pressure gas switch 100 of FIG. 1.

Figure 2:
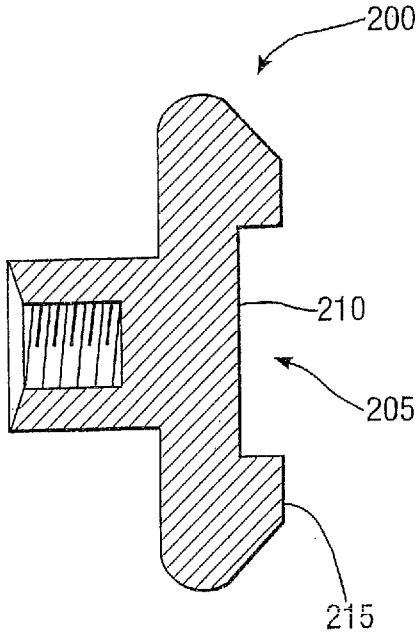
FIG. 2 is a sectional view through an electrode of a preferred design for use in the gas switch of FIG. 1 according to a second preferred embodiment of the present invention.

Referring firstly to FIG. 2, a sectional view is provide through an electrode 200 of a preferred design according to the second preferred embodiment, with dimensions shown in millimeters. A pair of the electrodes 200 is intended to form the electrodes 115, 120 in the gas switch 100 of FIG. 1. The electrode 200 is made preferably of brass and comprises a facing surface 205 having a flat central region 210 surrounded by a raised annular region 215. The radius of curvature of any rounded surface of the raised annular region 215 is relatively small in comparison with the intended width of the electrode 200 so that the raised surface features on the facing surface 205 serve to increase the surface area of the electrode over which erosion takes place. In the particular example shown in FIG. 2, the radius of curvature of each of the rounded edges of the raised annular region 215 is 0.5 mm, as indicated in FIG. 2, as compared with an overall diameter of the electrode 200 of 22.84 mm. Furthermore, as will be discussed below, the radius of curvature of the raised surface features is made significantly less than the intended electrode separation (indicated by D in the switch 100 of FIG. 1) so that the area over which field enhancement and hence enhanced erosion takes place is increased. The raised features 215 according to these preferred design considerations has been found to contribute to the extended operational life of the switch 100, typically of 400 to 1000 hours or more, according to preferred embodiments of the present invention.

Whereas this preferred design may be used for both of the electrodes 115, 120, substantially as shown in the example gas switch 100 of FIG. 1, the advantages of long operation life for a switch employing this first design of electrode 200 has been found to be preserved even though one of the electrodes is provided with an entirely flat facing surface 205. After a long period of operation of a switch 100 made according to this design, for example after a period of 400-500 hours or more, the initially flat facing surface has been found to have a shallow annular depression formed corresponding to the shape and position of the raised annular portion 215 of the opposite electrode. This has the effect of preserving or, in the case of an initially flat electrode, enhancing the degree of similarity in the profiles of the facing surfaces of the electrodes so as to maintain a substantially even gap between the electrodes and hence to maintain substantially even wear over their facing surfaces. Continued operation of the electrodes has been shown to be possible beyond the formation of these wear features in the surface of the flat electrode.

Referring now to FIG. 3*a*, a preferred design for a high voltage (HV) negative electrode 300 is shown according to a third preferred embodiment as a sectional view with dimensions indicated in millimeters. In this design, the facing surface 305 of the electrode is provided with an outer raised annular region 310 and a concentrically arranged inner raised annular region 315, with flat regions in between to give (in the sectional view) a "corrugated" facing surface 305 to the electrode 300. The preferred design for a corresponding positive, or ground electrode 350 is shown in sectional view in FIG. 3*b* to have a simple plane facing surface 355. As discussed above and as will be analysed further below, it has been found that the advantages of even electrode wear are preserved or indeed enhanced by the use of an initially flat electrode 350 in association with the electrodes 200, 300 of the second and third preferred embodiments respectively.

Whereas the electrodes 200, 300 described above use continuous raised annular portions, in a further preferred embodiment of the present invention an arrangement of discrete "mounds" may be provided across the facing surface of the HV electrode, rather than using one or more annuli. Each mound may have a similar radius of curvature to that of the annular portions in the first and second designs. However, advantageously, an arrangement of discrete mounds may provide a greater facing surface area for an electrode than that provided using continuous annuli and this feature is likely to contribute to extended electrode life.

A switch 100 according to preferred embodiments of the present invention, using electrodes of the preferred designs described above, is operated by applying a voltage across the electrodes 115, 120 which increases the electric field within the high pressure gas until breakdown occurs. The discharge following breakdown is a narrow plasma channel across the gap between the electrodes 115, 120. It has been observed that the breakdown channel predominantly occurs at points over the raised surface of an annulus or a discrete mound on the facing surface where the electric field strength is enhanced. However, surprisingly, the observed evenness of electrode wear over the raised surface features in particular, despite use of an initially flat-faced opposing electrode, suggests that breakdown occurs randomly at all points over the raise surface, not just that region at the apex of the raised surface for which the initial gap between electrodes is a minimum.

In a typical experiment, following a long period of operation of the switch 100 of the order of $100\times10^6$ switching shots, using the design of electrode 200 of the second preferred embodiment in place of the high voltage electrode 115 and a flat-faced electrode in place of the ground electrode 120, each having dimensions as indicated in the respective figures, the radius of curvature of the edges of the raised annular region 215 of the high voltage electrode 200 was reduced by 0.26 mm from nominal and the flat central region 210 was eroded 0.4 mm from nominal. The flat-faced ground electrode was also eroded and an annular depression, 0.2 mm deep, of substantially the same sectional profile as the raised annular region of the high voltage electrode, was worn in its flat facing surface.

During breakdown, the plasma channel diameter is small and its inductance is significant, thereby limiting the rate of rise of current through the switch 100. The electrical breakdown strength of the gas contained in the switch 100 increases almost linearly with pressure. Preferably, high gas pressure is used so that the required gap between the electrodes and hence the plasma channel length is substantially minimised. A reduced plasma channel length enables faster current rise and hence reduced switching time. Preferably, the gas contained in the switch 100 is at a pressure of between 300 psi and 1200 psi.

A further advantageous feature of a switch 100 according to preferred embodiments of the present invention described above is an observed reduced temperature dependence when the switch is used in a pulsed charge application. Conventionally, the breakdown voltage between electrodes of the switch is a function not only of gas pressure but also of gas temperature. Where, as in preferred embodiments of the present invention, a very high gas pressure is used, preferably in excess of 500 psi, if the gas switch 100 is charged in the first microsecond to a very high field strength, the breakdown voltage of the switch has been observed to become predominantly a function of the plasma channel formation time, rather than of gas temperature and pressure. This property is exploited in such applications to reduce the switch dependence on gas pressure/temperature, so increasing the temperature range over which the switch 100 operates at the required power levels.

A simplified analysis will now be provided to describe the principles of operation of a switch 100 according to preferred embodiments of the present invention. This analysis will be made with additional reference to FIGS. 4 to 7.

Referring firstly to FIG. 4, and considering the arrangement of electrodes shown in particular in the switch 100 of FIG. 1, the electric field across the gap between the raised annular regions of the electrodes 115, 120 can be estimated by considering the electric field between two conducting cylinders 400, 405 of radius R and separation D.

For an applied voltage of V volts between the cylinders 400, 405 the maximum electric field strength is given by the equation:

$$E_{MAX} = 0.9 \times \frac{\frac{V}{2}}{2.3 \times \ln\left(\frac{R + \frac{D}{2}}{R}\right)}$$

If a plane field existed within the gap, the electric field would be simply V/D (volts/meter). Preferably, the annular gap is designed such that the radius of the annulus, R, is smaller than the gap separation, D. In this situation, the maximum electric field is increased according to the equation:

$$\text{Enhancement} = \frac{E_{MAX}}{\frac{V}{D}}$$

A plot 500 of the enhanced E-Field is shown in FIG. 5. As can be seen from the plot 500 in FIG. 5, where R<<D the maximum electric field tends to become independent of the gap separation D.

Since the electric field is enhanced at the annular radius, R, and breakdown can be observed to occur at that radius, then spark erosion would be expected to be concentrated at the radius. However, surprisingly, in the switch 100 of the present invention, it has been observed that erosion occurs much more evenly across the spark gap facing surfaces.

For the preferred embodiments of the present invention in which there is one flat-faced positively charged electrode, the situation may be represented in a simplified diagram as shown in FIG. 6. A cylinder 600 of radius R is placed a distance D from a flat-faced electrode 605. In that arrangement, the maximum field strength is given by the equation:

$$E_{MAX} = 0.9 \times \frac{V}{2.3 \times \ln\left(\frac{R + D}{R}\right)}$$

A similar plot of the enhanced field due to the radius of the annular gap is shown in FIG. 7. Referring to FIG. 7, the plot 700 for the "single-ended" switch arrangement of FIG. 6 is provided along with the plot 500 for the "double-ended" switch arrangement from FIG. 4 and FIG. 5, for comparison. As can be seen from FIG. 7, a greater enhancement is achieved with the single-ended switch arrangement, which advantageously is also simpler and cheaper to produce.

Thus, the analysis supports the observation referred to above that the use of one flat-faced electrode and one "radiused" electrode in preferred embodiments of the switch 100 provides for increased field enhancement and hence reduced dependence upon electrode separation (which increases slightly as the electrodes wear). The use of a "corrugated" or discretely mounded facing surface for the HV electrode increases the surface area of the eroding face of the electrode and hence increases its operational life. The surprisingly even wear of the electrodes in this geometry works in tandem with the increased tolerance of electrode separation to further increase the operational life of the electrodes and hence of the switch 100. The use of brass as an electrode material, rather than a harder metal such as copper tungsten, has been observed to contribute to more even electrode wear in that the harder metals appear to be more susceptible to significant pitting than brass at the voltage, power and energy levels, indicated above, for which the present invention is preferably directed.

A yet further advantage, mentioned above, arises from operation of the switch 100 at the highest practical pressures, preferably in the range 300 psi to 1200 psi, but more preferably in excess of 500 psi. This enables the switch 100 to be operated in such a way as to increase the range of operational gas temperatures (and hence pressures) for which the switch 100 is able to switch at full design power.

In a fourth preferred embodiment of the present invention, a design for a simple pair of coaxial electrodes for use in the gas switch 100 of FIG. 1 will now be described with reference to FIGS. 8*a* and 8*b*.

Referring initially to FIG. 8*a*, a sectional view is provided through a preferred electrode 800 designed for use as a positive electrode in a gas switch similar to the switch 100 of FIG. 1. Referring to FIG. 8*b*, a sectional view is provided through a preferred electrode 850 designed for use as a negative electrode in such a gas switch. All dimensions shown in FIGS. 8*a* and 8*b* are expressed in millimeters.

The preferred positive electrode 800 is circular in shape and preferably of a two-part structure comprising a brass or copper tungsten electrode part 805 and a brass or copper connecting part 810 corresponding to the connecting portion 145 of the electrode 115 of FIG. 1. The electrode part is 31 mm in diameter. The connecting part 810 enables electrical connection with the electrode part 805 when mounted in the containment vessel of a gas switch, for example of the gas switch 100 of FIG. 1. The electrode part 805 is secured to the connecting part 810 preferably by means of a length of M3 studding 815 and the parts are soldered. The electrode part 805 is provided with a raised annular region 820 10 mm thick which surrounds a cavity 825 that is 12 mm in diameter and 6 mm deep. The raised annular region 820 of the electrode part 805 is provided with a rounded inner rim 830 of radius of curvature 0.5 mm and a rounded outer rim 835 of radius of curvature 4 mm.

Referring to FIG. 8*b*, the negative electrode 850 is also circular in shape and of a two-part structure comprising a brass or copper tungsten electrode part 855 and a brass or copper connecting part 860. The electrode part 855 is similarly secured to the connecting part 860 preferably by means of a length of M3 studding 865 and soldering. The electrode part 855 comprises a disc 8 mm thick and 31 mm in diameter with rounded edges. A cylindrical brass post 870 that is 6 mm long and 6 mm in diameter projects from the centre of a front face 875 of the disc. The post 870 is provided with a rounded rim 880 with radius of curvature 0.5 mm.

A gas switch incorporating the coaxial pair of positive and negative electrodes 800, 850 is shown in a sectional view in FIG. 9. Features shown that are common to those in FIGS. 8*a* and 8*b* are given the same numerical references.

Referring to FIG. 9, a portion of a high pressure gas switch 900 is shown in a sectional view, comprising a substantially cylindrical high pressure containment vessel 905 made preferably from a high strength metal such as stainless steel. Insulating members 910, preferably made from ceramic or a plastic such as nylon or polypropylene, serve both as the end walls of the high pressure containment vessel 905 and as electrically isolating supports for a pair of electrodes 800, 850. Sealing rings 915 are provided to seal the vessel 905 when in its assembled state with the insulating members 910 held securely in place by retaining members (not shown in FIG. 9). The containment vessel 905 provides a void 920 around the electrodes 800, 850 for holding a suitable gas, preferably nitrogen, hydrogen or $SF_6$, under very high pressure, preferably in the range of 300 psi to 1200 psi.

The electrodes 800, 850 are held in a fixed position as shown in FIG. 9 by the insulating members 910 so that there is a nominal gap L1 between the post (870 in FIG. 8*b*) of the negative electrode 850 and the base of the cavity (825 in FIG. 8*a*) of the positive electrode 800 and a nominal gap L2 between the raised annular portion (820 in FIG. 8*a*) of the positive electrode 800 and the front face (875 in FIG. 8*b*) of the negative electrode 850, so forming a coaxial arrangement of those parts of the electrodes 800, 850. In operation the electric field is enhanced in the region of the rounded rim (880 in FIG. 8*b*) of the post 870. The electrodes 800, 850 may be a arranged so that the highest electric field occurs at the rounded rim 880 of the post 870 where it has been found that erosion of the radius of curvature of the rim 880 occurs evenly such that the radius is substantially preserved throughout the life of the electrodes 800, 850.

In a preferred variation in the design of the electrodes 800, 850 of the fourth preferred embodiment, the post 870 may be extended slightly and provided with one or more further rounded rims to provide additional regions of electric field enhancement, with a similar advantage of increased erosion surface area to that provided by the additional concentric rims of the electrode 300 described above with reference to FIG. 3*a*. A gas switch incorporating this variation of the electrodes 800, 850 is shown in and will now be described with reference to FIG. 10.

Referring to FIG. 10, a substantially identical high pressure gas switch 950 is provided to that (900) shown in FIG. 9, having a cylindrical containment vessel 955, insulating members 960 supporting positive and negative electrodes 965, 970 respectively and containing a high pressure gas 975. The electrodes 965, 970 are substantially similar to the electrodes 800, 850 respectively of FIGS. 8*a* and 8*b*, but for a variation in the design of the post 870 of the electrode 850. In the negative electrode 970 in FIG. 10, a rounded rim 980 is provided around the side of a correspondingly elongated post 985 in addition and parallel to a rounded end rim 990. Preferably the radius of curvature of the additional rim 980 is 0.5 mm, and similarly for the end rim 990. In operation, the additional rim 980 provides a further region of field enhancement to that provided by the end rim 990, so increasing the erosion surface of the electrode 970 in comparison with that of the electrode 850.

The scope of the present invention, as defined in the claims, is intended to include variations on the designs for the gas switch 100 and for the electrodes 115, 120, as would be apparent to a person of ordinary skill in this field according to the principles described in preferred embodiments of the present invention described above.

The invention claimed is:

1. A high voltage switch, suitable for switching voltages of the order of several hundred kilovolts comprising:

a containment vessel for holding a gas under pressure;

first and second electrodes housed within the containment vessel and electrically isolated therefrom;

wherein the first and second electrodes are supported in a face-to-face arrangement whereby the facing surfaces of the first and second electrodes are separated by a nominal distance and the facing surface of the first electrode comprises at least one raised portion that is raised in comparison with the remainder of the facing surface, wherein the at least one raised portion of the first electrode comprises a raised annular region surrounding a center region at the center of the facing surface, wherein the center region has a diameter and is essentially flat over its entire area surrounded by the at least one raised portion, and wherein the second electrode is substantially flat over its entire area and has a diameter greater than the diameter of the center region of the first electrode.

2. The switch according to claim 1, where the at least one raised portion of the first electrode comprises a plurality of raised annular regions arranged over the facing surface.

3. The switch according to claim 2, wherein said plurality of raised annular regions are arranged concentrically.

4. The switch according to claim 1, wherein the at least one raised portion comprises a plurality of discrete locally raised regions distributed over the facing surface.

5. The switch according to claim 1, wherein the at least one raised portion comprises a rounded surface.

6. The switch according to claim 5, wherein the radius of curvature of the rounded surface is significantly less than the separation distance of the first and second electrodes.

7. The switch according to claim 1, wherein the pressure of the gas is at least 500 psi.

8. The switch according to claim 1, wherein at least one of the first and second electrodes is made from brass or a copper tungsten alloy.

9. The switch according to claim 1 wherein the gas comprises nitrogen, hydrogen or $SF_6$.

10. A high voltage switch, suitable for switching voltages of the order of several hundred kilovolts comprising:

a containment vessel for holding a gas at high pressure;

first and second electrodes housed within the containment vessel and electrically isolated therefrom, each defining an electrode diameter;

wherein the first and second electrodes are supported in a face-to-face arrangement whereby the facing surfaces of the first and second electrodes are separated by a nominal distance and the facing surface of the first electrode comprises at least one raised portion that is raised in comparison with the remainder of the facing surface, wherein the at least one raised portion of the first electrode comprises a raised annular region surrounding a center region at the center of the facing surface, wherein the center region is essentially flat over its entire area surrounded by the at least one raised portion, wherein the second electrode is substantially flat over its entire area and has a diameter greater than the diameter of the center region of the first electrode, and wherein the containment vessel contains a gas at a pressure in the range of 300 psi to 1200 psi.

11. A high voltage switch, suitable for switching voltages of the order of several hundred kilovolts comprising:

a containment vessel for holding a gas under pressure;

first and second electrodes housed within the containment vessel and electrically isolated therefrom;

wherein the first and second electrodes are supported in a face-to-face arrangement whereby the facing surfaces of the first and second electrodes are separated by a nominal distance and the facing surface of the first electrode comprises at least one raised portion that is raised in comparison with the remainder of the facing surface, wherein the at least one raised portion of the first electrode comprises a raised annular region surrounding a center region at the center of the facing surface, wherein the center region has a diameter and is essentially flat over its entire area surrounded by the at least one raised portion, wherein the second electrode is substantially flat over its entire area and has a diameter greater than the diameter of the center region of the first electrode, and wherein the raised annular region defines a rim edge, the rim edge having a radius of curvature and the ratio of the rim edge radius of curvature to the second electrode diameter is between approximately 1:45 and 1:65.

12. The switch according to claim 11, wherein the rim edge is an inner rim edge where the raised annular portion meets the flat central region.

13. The switch according to claim 12, wherein the radius of curvature is 0.5 mm.

* * * * *